US007673977B2

(12) United States Patent
Terada

(10) Patent No.: US 7,673,977 B2
(45) Date of Patent: Mar. 9, 2010

(54) INK CARTRIDGE AND INK FILLING APPARATUS

(75) Inventor: Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 727 days.

(21) Appl. No.: 11/465,709

(22) Filed: Aug. 18, 2006

(65) Prior Publication Data

US 2007/0056455 A1 Mar. 15, 2007

(30) Foreign Application Priority Data

Aug. 23, 2005 (JP) ..... 2005-240736

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS 5,933,174 A 8/1999 Kawazoe et al.

FOREIGN PATENT DOCUMENTS

| | | | |
|---|---|---|---|
| CN | 2353532 | Y | 12/1999 |
| EP | 0878309 | A2 | 11/1998 |
| JP | 44801 | | 6/1993 |
| JP | 338198 | | 12/1993 |
| JP | H07-276659 | A | 10/1995 |
| JP | 11319 | | 1/1996 |
| WO | 9401287 | A1 | 1/1994 |

OTHER PUBLICATIONS

European Patent Office, European Search Report for Related EP Application No. 06017573 dated Nov. 17, 2006.

State Intellectual Property Office, Notification of First Office Action in Chinese Patent Appl'n No. 200610121627.8 (counterpart to above-captioned US patent application) mailed Apr. 4, 2008.

*Primary Examiner*—Julian D Huffman
(74) *Attorney, Agent, or Firm*—Baker Botts L.L.P.

(57) ABSTRACT

There is disclosed an ink cartridge including a cylindrical member having an ink port at one axial end thereof, a piston, a piston rod, and a thrusting portion. The piston rod is fitted in the cylindrical member air-tightly and slidably, and partially defines an ink chamber within the cylindrical member. The ink chamber is in communication with the ink port. The piston rod is connected to the piston on the side opposite to the ink chamber, and extends in the cylindrical member along an axial direction of the cylindrical member. The thrusting portion is at least partially positioned in the cylindrical member and configured to apply a thrust force to the piston rod and thereby move the piston along the axial direction. The thrusting portion comprises a driven portion drivable from the exterior of the cylindrical member.

19 Claims, 11 Drawing Sheets

INK CARTRIDGE AND INK FILLING APPARATUS

INCORPORATION BY REFERENCE

The present application is based on Japanese Patent Application No. 2005-240736, filed on Aug. 23, 2005, the contents of which are incorporated herein by reference.

BACKGROUND OF THE INVENTION

1. Field of the Invention

The present invention relates to an ink cartridge and an ink filling apparatus.

2. Description of Related Art

As a kind of ink cartridge, an ink container for an inkjet printhead is disclosed in JP-A-5-338198, for instance. The ink container includes a cylindrical member as a mainbody, and an ink outflow port is formed in a wall of the cylindrical member at an axial end thereof. The ink container further includes a piston that is air-tightly and slidably fitted in the cylindrical member.

It can be considered that the ink container is filled with an ink such that the ink is fed into the cylindrical member through the ink outflow port, with the piston being slid in a direction away from the wall in which the ink outflow port is formed.

Meanwhile, JP-U-5-44801 discloses an adjusting apparatus for a packaging machine which adjusts an amount of a filling material supplied into a container or a package. The adjusting apparatus includes a filling cylinder, a piston slidably or reciprocably fitted in the cylinder, an L-shaped lever or a bell crank having a slot extending in and along one of two arms thereof and a screw shaft disposed in the slot parallel to a longitudinal direction of the slot. A slider is slidably fitted in the slot and threadably engaged with the screw shaft, and the piston is connected to the slider via a piston rod extending downward from the piston out of the filling cylinder, and a connecting rod. The arm of the bell crank in which the slot extends is disposed under the filling cylinder to be swingable or turnable around a pivot shaft.

When the filling cylinder is to be filled with a liquid as the filling material the arm of the bell crank is swung or turned around the pivot shaft away from the filling cylinder in order to lower the piston in the filling cylinder to introduce the liquid into the filling cylinder from a port formed in an upper wall of the filling cylinder.

The adjusting apparatus has a drawback that the piston rod and the connecting rod are connected to each other such that each of the piston rod and the connecting rod is pivotable about an axis that corresponds to a connecting point between the piston rod and the connecting rod, and thus an amount of movement of the piston is not simply or linearly proportional to an angle of swinging or turning of the bell crank.

Accordingly, an amount of the liquid poured out from the filling cylinder toward a nozzle from which the liquid is ejected into the package, is not simply or linearly proportional to the angle of the swinging or turning of the bell crank. Thus, controlling the adjusting apparatus is difficult, resulting in lower accuracy and precision of the adjustment of the amount of the filling material.

The adjusting apparatus is disadvantageous also in the complex connecting structure between the piston and the bell crank. That is, the piston is connected to the piston rod that is connected to the connecting rod. that is in turn connected to the slider fitted in the slot of the bell crank.

SUMMARY OF THE INVENTION

This invention has been developed in view of the above-described situations, and therefore the invention provides an ink cartridge and an ink filling apparatus which is simple in structure.

To attain the above object, a first mode of the invention provides an ink cartridge including a cylindrical member, a piston, a piston rod, and a thrusting portion. The cylindrical member has an ink port at one axial end thereof. The piston is air-tightly and slidably fitted in the cylindrical member, and partially defines an ink chamber within the cylindrical member. The ink chamber is in communication with the ink port. The piston rod is connected to the piston on the side opposite to the ink chamber, and extends in the cylindrical member along an axial direction of the cylindrical member. The thrusting portion is at least partially positioned in the cylindrical member and configured to apply a thrust force to the piston rod and thereby move the piston along-the axial direction. The thrusting portion comprises a driven portion drivable from the exterior of the cylindrical member.

In this ink cartridge, the piston can be moved or slid in the cylindrical member by simply driving the driven portion from the exterior of the cylindrical member. Thus, the ink cartridge or its ink chamber can be easily filled with the ink, with a simple structure.

According to a second mode of the invention, there is provided an ink cartridge including a cylindrical member, a piston, a feed screw, and an internally threaded member. The cylindrical member has an ink port at one axial end thereof. The piston is fitted in the cylindrical member air-tightly and slidably, and partially defines an ink chamber within the cylindrical member. The ink chamber is in communication with the ink port. The feed screw is connected to the piston on the side opposite to the ink chamber, and extends along an axial direction of the cylindrical member. The internally threaded member is threadably engaged with the feed screw, and configured to be rotatable relative to the cylindrical member in a plane perpendicular to the axial direction of the cylindrical member but immovable relative to the cylindrical member in the axial direction of the cylindrical member. At least a part of the internally threaded member is operable from the exterior of the cylindrical member.

According to the second mode, the ink chamber can be easily filled with the ink with high accuracy and precision, while the structure of the ink cartridge is simplified.

Arrangements applicable to the first mode are applicable to the second mode, too.

The invention also provides an ink filling apparatus including an ink cartridge, a cartridge holder which detachably holds the ink cartridge, an ink tank, and a drive unit. The ink cartridge accords to one aspect of the first mode which includes a cylindrical member having an ink port at one axial end thereof, a piston which is fitted in the cylindrical member air-tightly and slidably and partially defines an ink chamber within the cylindrical member such that the ink chamber is in communication with the ink port, a feed screw shaft which is connected to the piston on the side opposite to the ink chamber and extends along an axial direction of the cylindrical member, and an internally threaded member threadably engaged with the feed screw shaft and configured to be rotatable relative to the cylindrical member in a plane perpendicular to the axial direction of the cylindrical member but immovable relative to the cylindrical member in the axial direction of the cylindrical member. At least a part of the internally threaded member is operable from the exterior of the cylindrical member.

According to the ink filling apparatus, the drive unit operates or rotates the internally threaded member while the ink cartridge is held by the cartridge holder, so as to fill the ink cartridge or its ink chamber with the ink supplied from the ink tank. Thus, the ink filling apparatus is simple in structure and can easily fill the ink chamber with the ink, with high accuracy and precision.

Arrangements applicable to an ink cartridge according to each of the first and second modes as defined in the relevant claim groups in the appended claims are applicable to the ink filling apparatus, too.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an ink filling apparatus according to presently preferred embodiments of the invention, by referring to the accompanying drawings.

Figure 1:
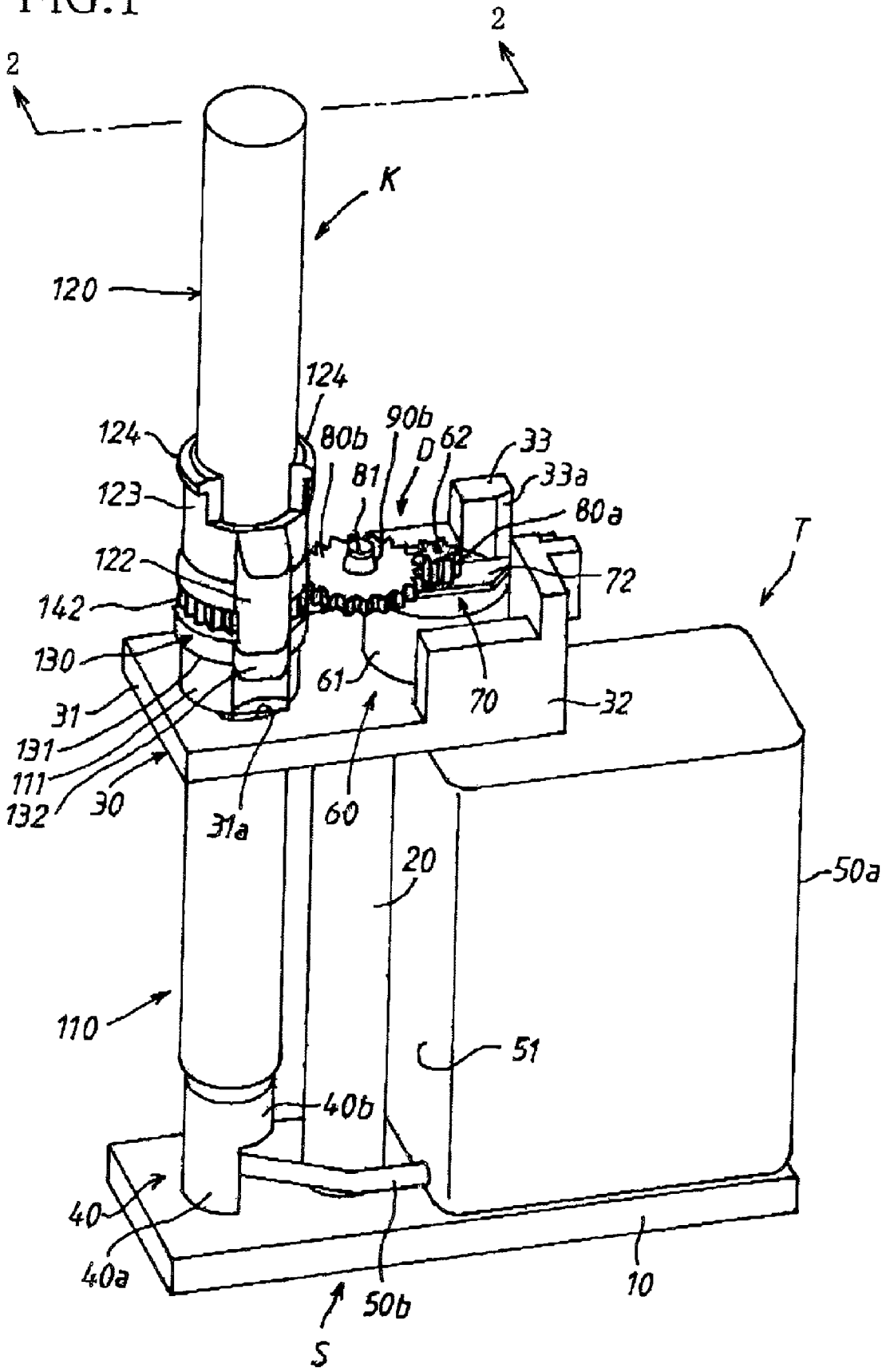
FIG. 1 is a perspective view of an ink filling apparatus according to a first embodiment of the invention.
Figure 2:
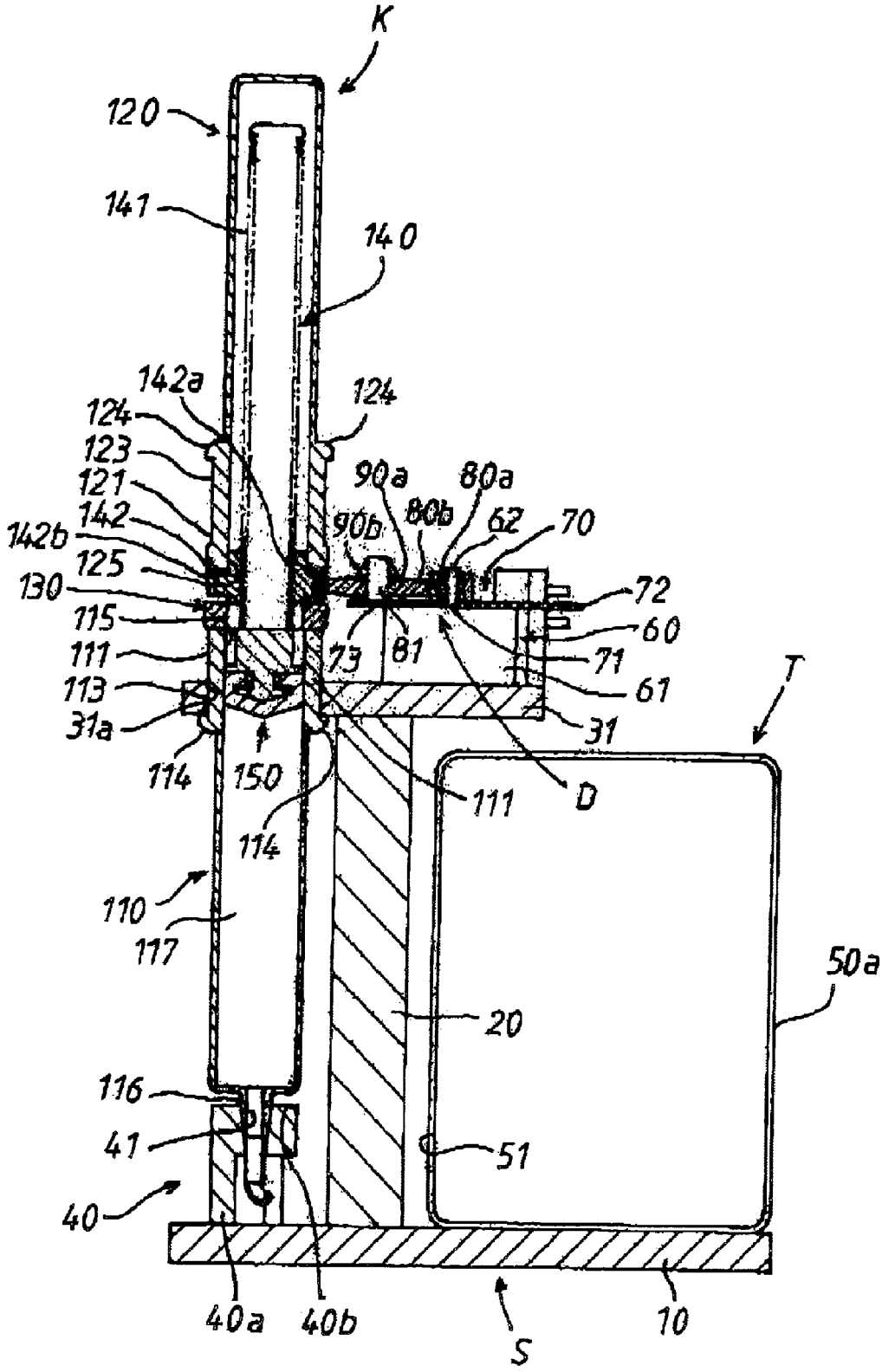
FIG. 2 is a cross-sectional view taken along line 2-2 in FIG. 1.

Referring to FIGS. 1-9, there will be described an ink filling apparatus according to a first embodiment of the invention. FIGS. 1 and 2 show the ink filling apparatus in perspective view and in cross-sectional view, respectively. The left and right sides in FIGS. 1 and 2 correspond to the front and rear sides of the ink filling apparatus, respectively.

The ink filling apparatus is used for filling an ink cartridge K with an ink, and includes a cartridge holder S, an ink tank T, and a drive unit D, as shown in FIG. 1.

As shown in FIG. 1, the cartridge holder S includes a plate-like base 10, a column 20, a support table 30, and a connecting portion 40. The column 20 stands upright on the base 10 at a front and laterally central position therein.

The support table 30 includes a board 31, and a right side wall 32 and a left side wall 33. The support table 30 is supported by. the column 20 with an upper end of the column 20 fixed to a central portion of an under surface of the board 31.

Figure 3:
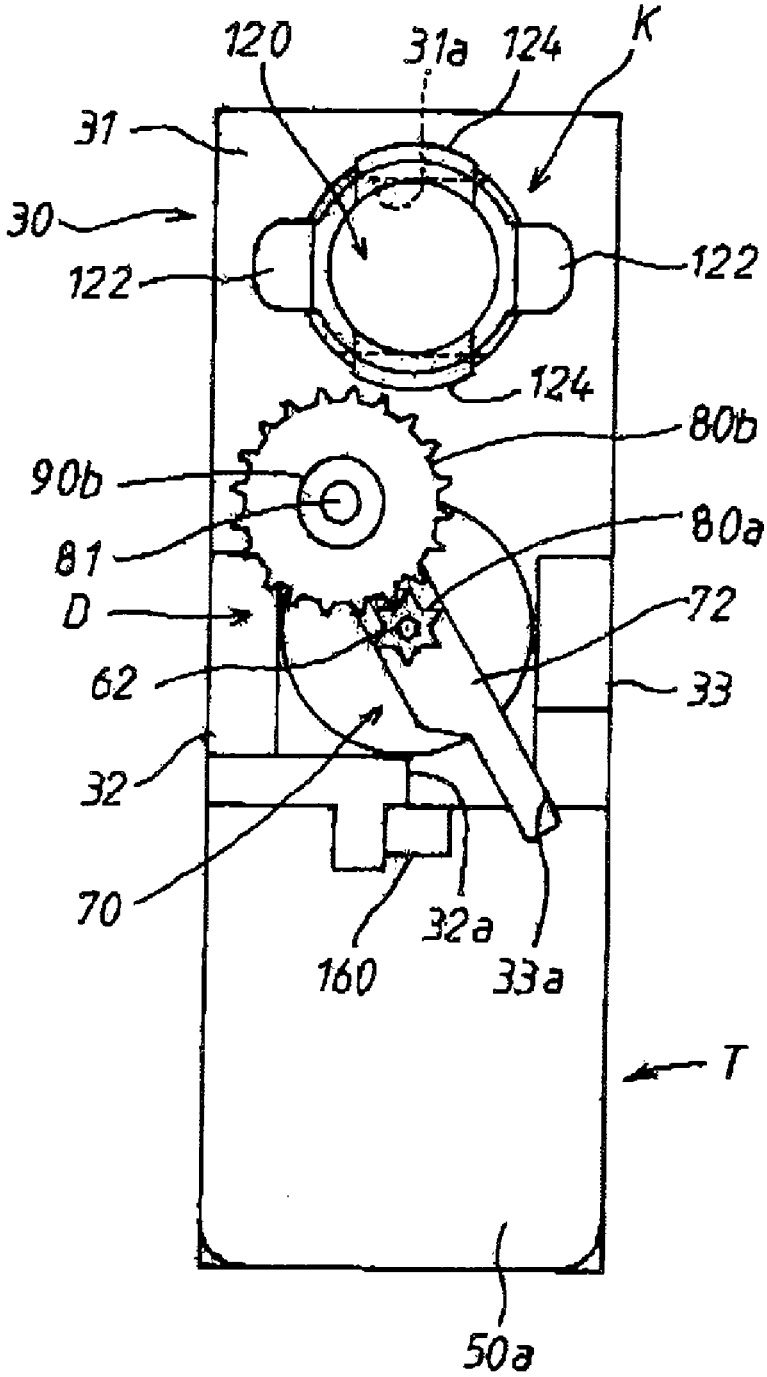
FIG. 3 is a plan view of the ink filling apparatus in a state where an arm member engages a first stopper portion.
Figure 4:
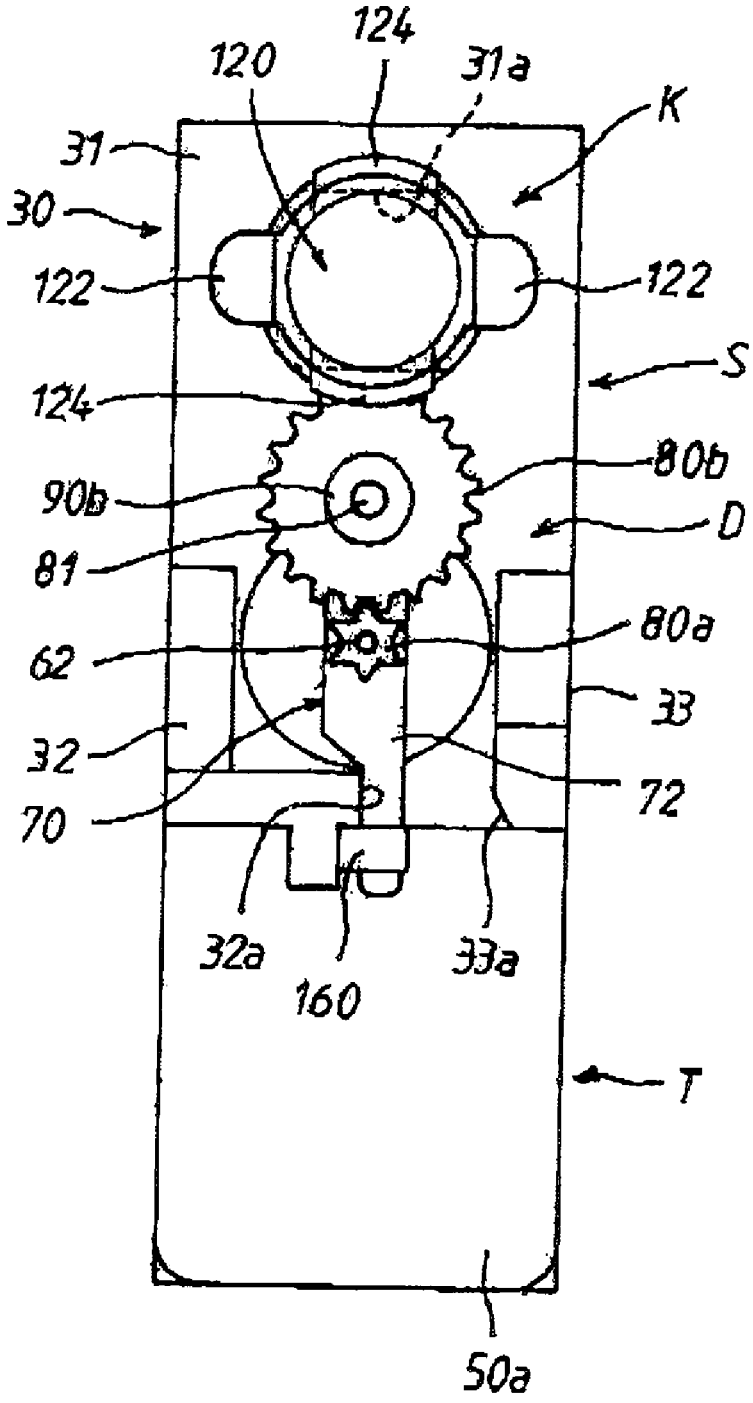
FIG. 4 is a plan view of the ink filling apparatus in a state where the arm member is engaged with a second stopper portion.

The board 31 is disposed parallel to the base 10. At a front and laterally central position in the board 31, there is formed an insertion through-hole 31*a*, through which the ink cartridge K is inserted. In plan view, the insertion through-hole 31*a* has a non-circular shape. For instance, in plan view, the insertion through-hole 31*a* has a flatted round shape, as shown in FIGS. 3 and 4, in other words, a shape obtained by cutting off two minor segments at two sides opposite to each other, from a circle.

As shown in FIG. 1, the right side wall 32 (which is a wall presented at the left side in FIGS. 3 and 4) extends upright from a rear portion of the board 31. The right side wall has an L-like shape in plan view, that is, the right side wall 32 has two segments, a first one of which extends along a right edge of the board 31, and a second one of which extends along a rear edge of the board 31. An end surface of the second segment of the right side wall 32, which surface is remote from the first segment, serves as a first stopper portion 32*a* (shown in FIGS. 3 and 4) for limiting swinging or turning movement of an arm member 70. The first stopper portion 32*a* will be described later.

As shown in FIG. 1, the left side wall 33 extends upright from a left rear position of the board 31. A rear end portion of an inner surface of the left side wall 33 is opposed to the first stopper portion 32*a*, and serves as a second stopper portion 33*a* (shown in FIGS. 3 and 4) for limiting swinging or turning movement of the arm member 70. The first and second stopper portions 32*a*, 33*a* cooperate to constitute a turn limiter.

The connecting portion 40 receives or supports the ink cartridge K from the under side, and includes a semi-cylindrical base portion 40*a* and a columnar receiving portion 40*b*. The base portion 40*a* is disposed on the base 10 at a front and laterally central position therein, with an inner circumferential surface of the base portion 40*a* facing rearward. As shown in FIG. 2, the receiving portion 40*b* extends rearward from an upper end of the base portion 40*a*, so that the connecting portion 40 has an L-like shape in the cross-sectional view of FIG. 2. The receiving portion 40*b* has a fitting hole 41.

The ink tank T includes a mainbody 50*a* in which an ink is stored, and a supply tube 50*b* providing a communication passage. The mainbody 50*a* is disposed on a rear portion of the base 10. The supply tube 50*b* extends frontward from a right lower end position of a front wall 51 of the mainbody 50*a*. The other end of the supply tube 50*b* is located inside the base portion 40*a* of the connecting portion 40. The supply tube 50*b* may be a member separate from the ink tank K. Where the supply tube 50*b* is a member separate from the ink tank K, it can be considered that the supply tube 50*b* does not constitute a part of the ink tank K.

As shown in FIGS. 1 and 2, the drive unit D includes a stepper motor 60. The stepper motor 60 has a mainbody 61 that is fixed in position between the right and left side walls 32, 33 on the board 31 of the support table 30. The stepper motor 60 has an output shaft 62 or a rotating shaft, which extends upward through the mainbody 61 to a position over an upper end surface of the mainbody 61.

As shown in FIGS. 1 and 2, the drive unit D further includes an elongate arm member 70 as a turnable member. As shown in FIG. 2, the arm member 70 has a through-hole 71 at its central position in a longitudinal direction thereof. The arm member 70 is attached to the stepper motor 60 such that the output shaft 62 is fitted in the through-hole 71, which has a diameter larger than an external diameter of the output shaft 62. The arm member 70 is thus coupled to the output shaft 62 of the stepper motor 60 at its through-hole 71, such that the arm member 70 is swingable or turnable around the output shaft 62 of the stepper motor 60.

As shown in FIG. 2, the arm member 70 has a first arm 72 and a second arm 73 on the opposite sides of the through-hole 71. A free end portion of the first arm 72 is located between the first and second stopper portions 32*a*, 33*a* in the support table 30, as shown in FIGS. 3 and 4.

As shown in FIG. 3, turning or swinging movement of the arm member 70 in a counterclockwise direction as seen in FIG. 3 is limited by the end portion of the first arm 72 being brought into abutting contact with the second stopper portion 33*a*. On the other hand, turning or swinging movement of the arm member 70 in a clockwise direction as seen in FIG. 3 is limited by the end portion of the first arm 72 being brought into abutting contact with the first stopper portion 32*a*, as shown in FIG. 4.

The drive unit D further includes a pinion 80*a* (motor gear), and an idler gear 80*b* (drive gear). The pinion 80*a* is supported over the arm member 70 coaxially with the output shaft 62 of the stepper motor 60. The pinion 80*a* rotates with the stepper motor 60 in the same direction as the stepper motor 60. The stepper motor 60 can rotate in two opposite directions, i.e., a forward direction that is the clockwise direction as seen in FIGS. 3 and 4, and a reverse direction that is the counterclockwise direction as seen in FIGS. 3 and 4.

Figure 5:
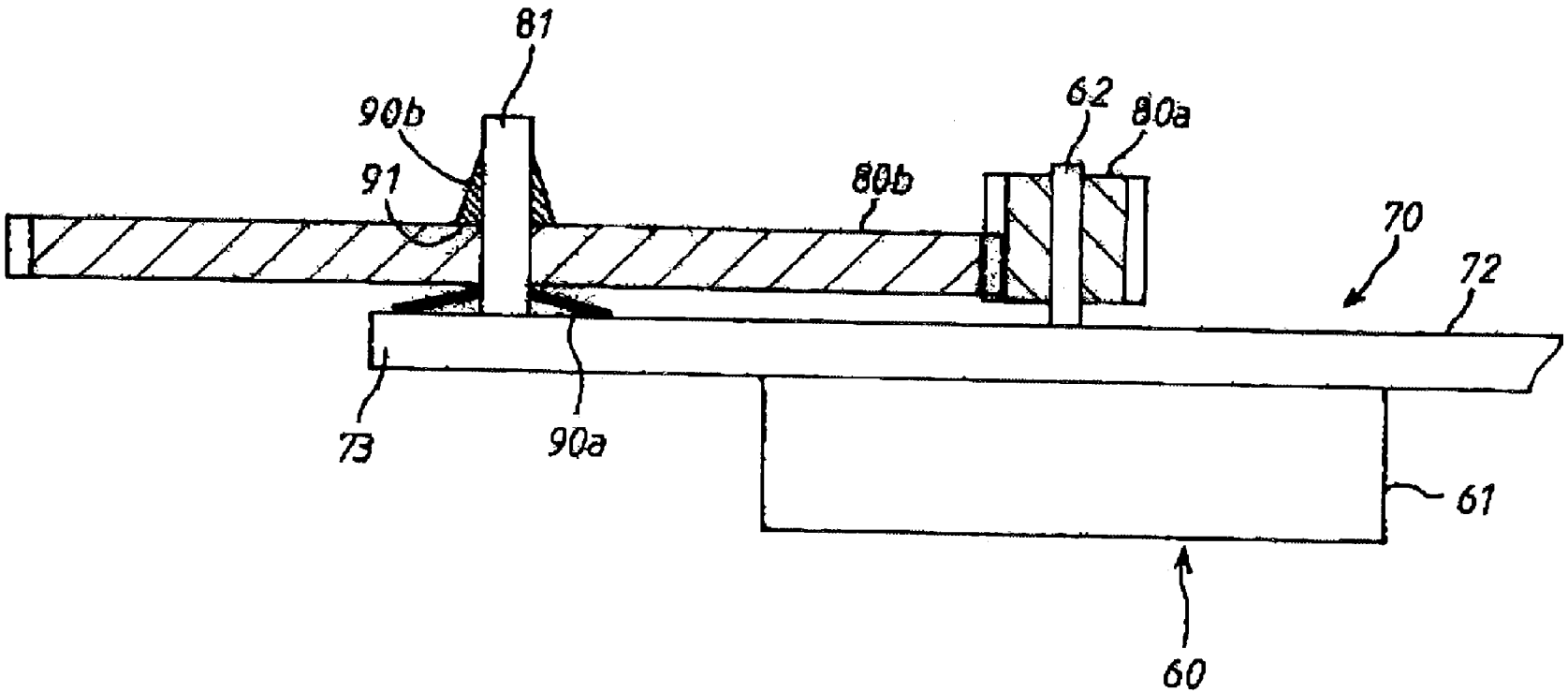
FIG. 5 is an enlarged fragmentary view of the ink filling apparatus, showing a positional relationship between a spring and a frictional member.

As shown in FIGS. 2 and 5, the idler gear 80*b* is supported coaxially with a support shaft 81 that extends upward from an end portion of the second arm 73 of the arm member 70, such that the idler gear 80*b* is rotatable relative to the support shaft 81. The idler gear 8O*b* is in meshing engagement with the pinion 80*a*, Hence, provided that the first arm 72 of the arm member 70 is engaged, or held in contact, with the first stopper portion 32*a*, the idler gear 80*b* rotates with the pinion 80*a* in a direction opposite to the direction in which the pinion 80*a* rotates, as described later.

Between the idler gear 80*b* and the end portion of the second arm 73, there is disposed a coned disc spring or a conical spring washer 90*a*, as shown in the enlarged view of FIG. 5. The conical spring washer 90*a* is fitted on the support shaft 81.

The conical spring washer 90*a* is convex upward in cross section, and interposed, with preload, between the idler gear 80*b* and the end portion of the second arm 73. Thus, an elastic force of the conical spring washer 90*a* biases the idler gear 80*b* against a conical frictional member 90*b* shown in FIG. 5.

The frictional member 90*b* is disposed around an upper portion of the support shaft 81 to be coaxial with the support shaft 81, as shown in FIG. 5. An under surface of the frictional member 90*b* is a frictional surface 91, that is, the frictional member 90*b* is in frictional contact at its under surface with a central portion of an upper surface of the idler gear 80*b* that is biased upward by the conical spring washer 90*a*. The frictional force generated at the frictional surface 91 of the frictional member 90*b* and other factors are so adjusted that while the arm member 70 is turned or swung, by rotation of the stepper motor 60, in the clockwise direction as seen in FIGS. 3 and 4 away from the second stopper portion 33*a* to be brought into contact with the first stopper portion 32*a*, the idler gear 80*b* and the arm member 70 together rotate or turn around the output shaft 62 of the stepper motor 60, but after the arm member 70 is brought into contact with the first stopper portion 32*a* and the idler gear 80*b* is brought into meshing engagement with an external gear portion 142*b* as an external engaging portion, a rotating force from the stepper motor 60 rotates the idler gear 80*b* relative to the arm member 70 to in. turn rotate the internally threaded member 142, as described later, with the arm member 70 being inhibited from further turning by its contact with the first stopper portion 32*a*. That is, when the stepper motor 60 is rotated in the forward direction, after the arm member 70 is brought into contact with the first stopper portion 32*a*, the idler gear 80*b* rotates in sliding contact with the frictional surface 91 of the frictional member 90*b* while the arm member 70 is stationary.

The ink cartridge K includes a cylinder 100 (cylindrical member) as an ink container and the cylinder 100 includes a first cylindrical part 110, a second cylindrical part 120, and an annular assisting member 130, as shown in FIGS. 1, 2, 6 and 7.

Figure 6:
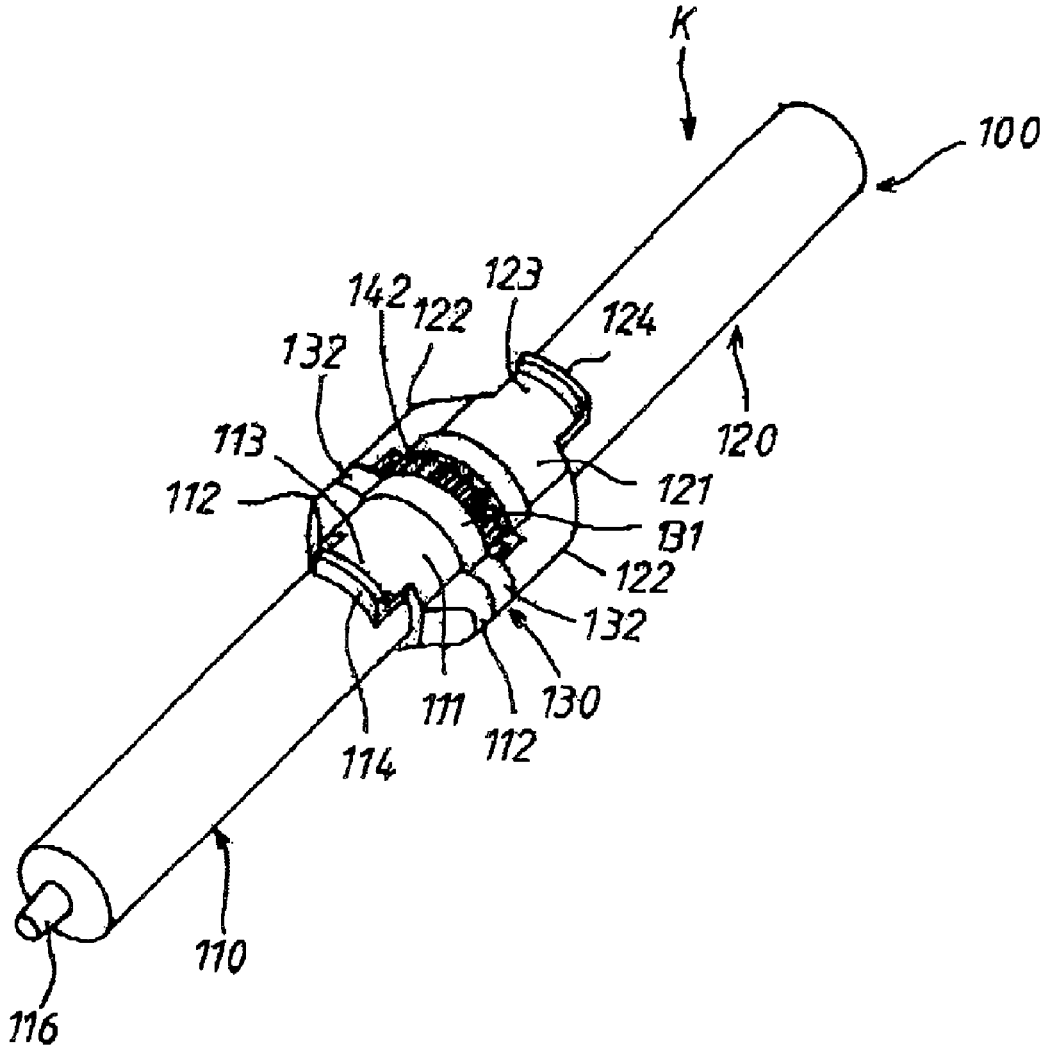
FIG. 6 is a perspective view of an ink cartridge shown in FIG. 1.

The first and second cylindrical parts 110, 120 are coaxially attached to each other with the annular assisting member 130 interposed therebetween, as shown in FIGS. 1, 2 and 6. The first cylindrical part 110 includes a large diametered portion 111 (shown in FIGS. 6 and 7) and two linking protrusions 112 (shown in FIGS. 1, 2, 6 and 7). The large diametered portion 111 is formed on an end portion of the first cylindrical part 110. The linking protrusions 112 are formed to protrude from an outer surface of the large diametered portion 111 radially and in opposite directions.

Figure 7:
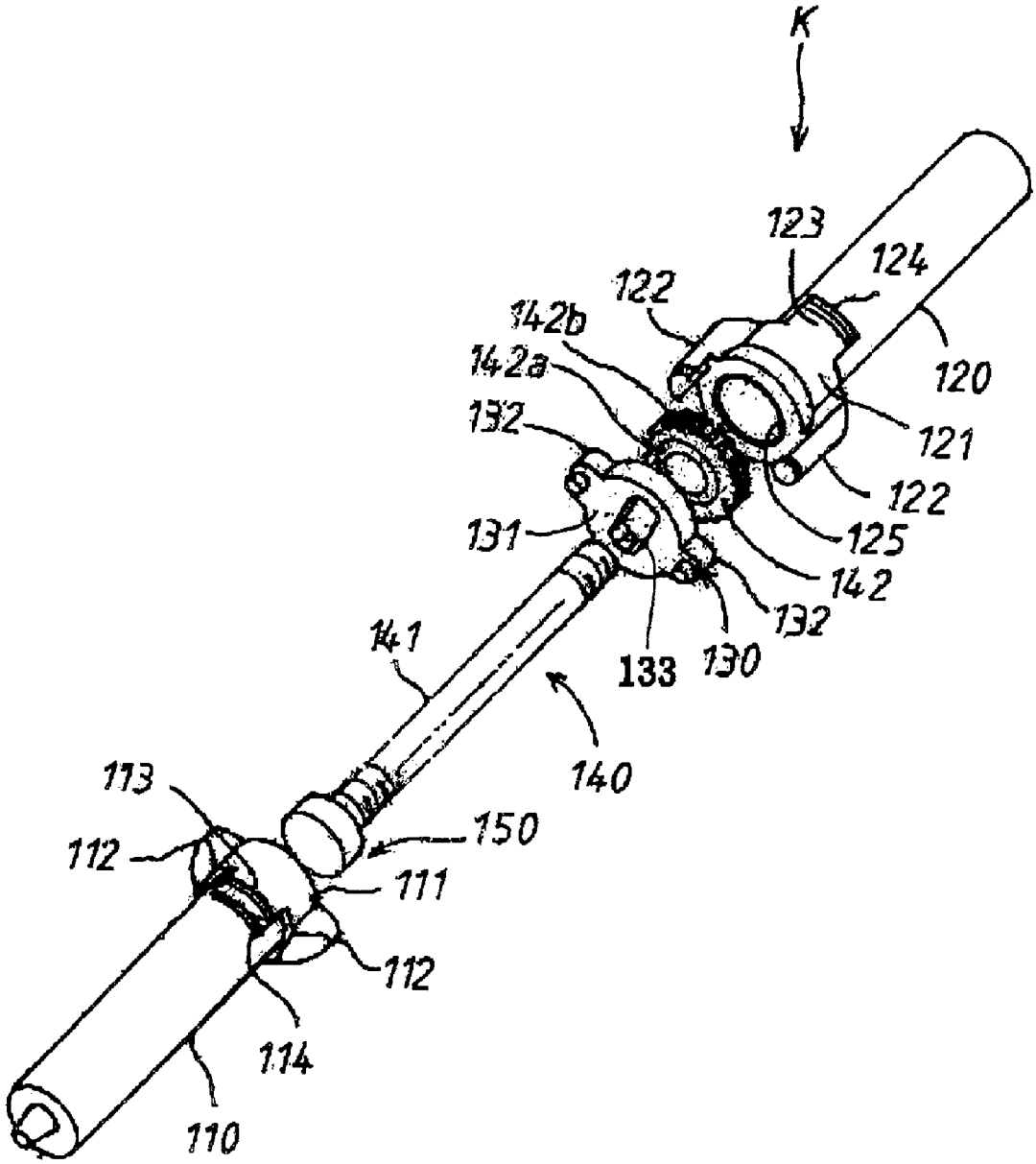
FIG. 7 is an exploded perspective view of the ink cartridge.

The first cylindrical part 110 further includes two leg portions 113 and two arcuate protrusions 114, that are shown in FIGS. 2, 6 and 7. The leg portions 113 are formed on the outer circumferential surface of the first cylindrical part 110. Each of the leg portions 113 extends from the large diametered portion 111 in an axial direction of the first cylindrical part 110 away from the second cylindrical part 120. The leg portions 113 are disposed opposite to each other, that is, separate from each other at 180° in a circumferential direction of the cylinder 100. The arcuate protrusions 114 respectively protrude from ends of the leg portions 113 in radially opposite directions.

Hence, the first cylindrical part 110 is positioned on the connecting portion 40 on the base 10 such that the linking protrusions 112 and the arcuate protrusions 114 hold an edge of the insertion through-hole 31*a* (i.e., a portion of the board 31 around the insertion through-hole 31*a*), from the upper and lower sides, respectively, whereby the first cylindrical part 110 is engaged with the edge.

As shown in FIG. 2, the first cylindrical part 110 has an ink port 116 at one of two opposite axial ends thereof, and its other axial end is open, which open end is designated by reference numeral 115. The ink port 116 is in communication with an inside space of the first cylindrical part 110.

The ink port 116 of the first cylindrical part 110 is inserted into the fitting hole 41 of the connecting portion 40 on the base 10 so as to be connected to the supply tube 50*b* of the ink tank T.

The second cylindrical part 120 includes a large diametered portion 121 (shown in FIGS. 2, 6 and 7) and two linking protrusions 122 (shown in FIGS. 1, 6 and 7). The large diametered portion 121 is formed on and along an outer circumferential surface of an axial end portion of the second cylindrical part 120. The linking protrusions 122 protrude from an outer surface of the large diametered portion 121 in respective radial directions that are opposite to each other, and extend in an axial direction of the cylindrical member 100 toward the annular assisting member 130.

The second cylindrical part 120 further includes two leg portions, 123 and two arcuate protrusions 124. The leg portions 123 are formed on the outer circumferential surface of the second cylindrical part 120. Each of the leg portions 123 extends from the large diametered portion 121 along the axial direction of the second cylindrical part 120 in an axial direction thereof away from the first cylindrical part 110. The leg portions 123 are formed at respective positions that are separate from each other at 180° in the circumferential direction of the cylinder 100. The arcuate protrusions 124 protrude from ends of the leg portions 123 in respective radial directions opposite to each other. When the ink cartridge K is attached to a printer or others, the large diametered portion 121 and the arcuate protrusions 124 cooperate to fix the ink cartridge K in position.

One of two opposite axial ends of the second cylindrical part 120 is open, which open end is designated by reference numeral 125. The open end 125 is opposed to the open end 115 of the first cylindrical part 110 via the annular assisting member 130, as shown in FIG. 2.

The annular assisting member 130 includes an annular portion 131 and two linking protrusions 132. The annular portion 131 is interposed between the open ends 115, 125 of the cylindrical parts 110, 120 such that, the annular portion 131 and the cylindrical parts 110, 120 are coaxial. The linking protrusions 132 radially protrude from an outer circumferential surface of the annular portion 131 in respective directions that are opposite to each other. The linking protrusions 132 of the annular assisting member 130 are sandwiched between the linking protrusions 112 of the first cylindrical part 110 and the linking protrusions 122 of the second cylindrical part 120, and secured, for instance, by bonding, or using a plurality of screws.

As shown in FIGS. 2 and 7, the ink cartridge K includes a feed screw mechanism 140, and a piston 150 formed of rubber. The threaded shaft 141 extends inside the first and second cylindrical parts 110, 120 across the annular assisting member 130, that is, the threaded shaft 141 is movable in the axial direction of the cylinder 100 through a through-hole 133 of the annular assisting member 130.

An inner circumferential surface 142*a* of the internally threaded member 142 serves as an internal engaging portion at which the threaded shaft 141 is threadably engaged with the internally threaded member 142. When rotated, the internally threaded member 142 operates to feed the threaded shaft 141. On an outer circumferential surface of the internally threaded member 142, there is formed the above-mentioned external gear portion 142*b*, which is exposed to the exterior of the cylinder 100 at an axial position between a surface of the annular assisting member 130 and a surface of the second cylindrical part 120 which surfaces are opposed to each other. The internally threaded member 142 has at its upper end thereof a fitting portion that is fitted in the open end 125 of the second cylindrical part 120, whereby the radial position of the internally threaded member 142 relative to the cylinder 100 is determined. It is noted that the annular assisting member 130 functions to prevent the threaded shaft 141 from rotating with the internally threaded member 142 when the internally threaded member 142 is rotated by rotation of the idler gear 80*b*, as described later. That is, if there is not disposed the annular assisting member 130, the threaded shaft 141 only rotates with the internally threaded member 142 and can not axially move. As shown in FIG. 7, the threaded shaft 141 has a flatted round shape in cross section as taken perpendicular to its axial direction, which shape conforms to a shape of the through-hole 133 in the annular assisting member 130. That is, an outer circumferential surface of the threaded shaft 141 has two flat portions at the right and left sides thereof as seen in FIG. 7, and each portion between the two flat portions is curved. The threaded shaft 141 is threaded only at the curved portions. As the ink cartridge K is assembled, the flat portions of the outer circumferential surface of the threaded shaft 141 contact straight or flat portions of an inner circumferential surface of the through-hole 133 of the annular assisting member 130, thereby inhibiting the threaded shaft 141 from rotating with rotation of the internally threaded member 142. Thus, rotating movement of the internally threaded member 142 is converted into a linear or axial movement of the threaded shaft 141.

The piston 150 is held at one of opposite axial ends of the threaded shaft 141 which is on the side of the first cylindrical part 110. The piston 150 is coaxial with the threaded shaft 141, and air-tightly slidable in the first cylindrical part 110. The piston 150 partially defines an ink chamber 117 inside the first cylindrical part 110. The ink chamber 117 is in communication with the ink port 116.

Figure 8:
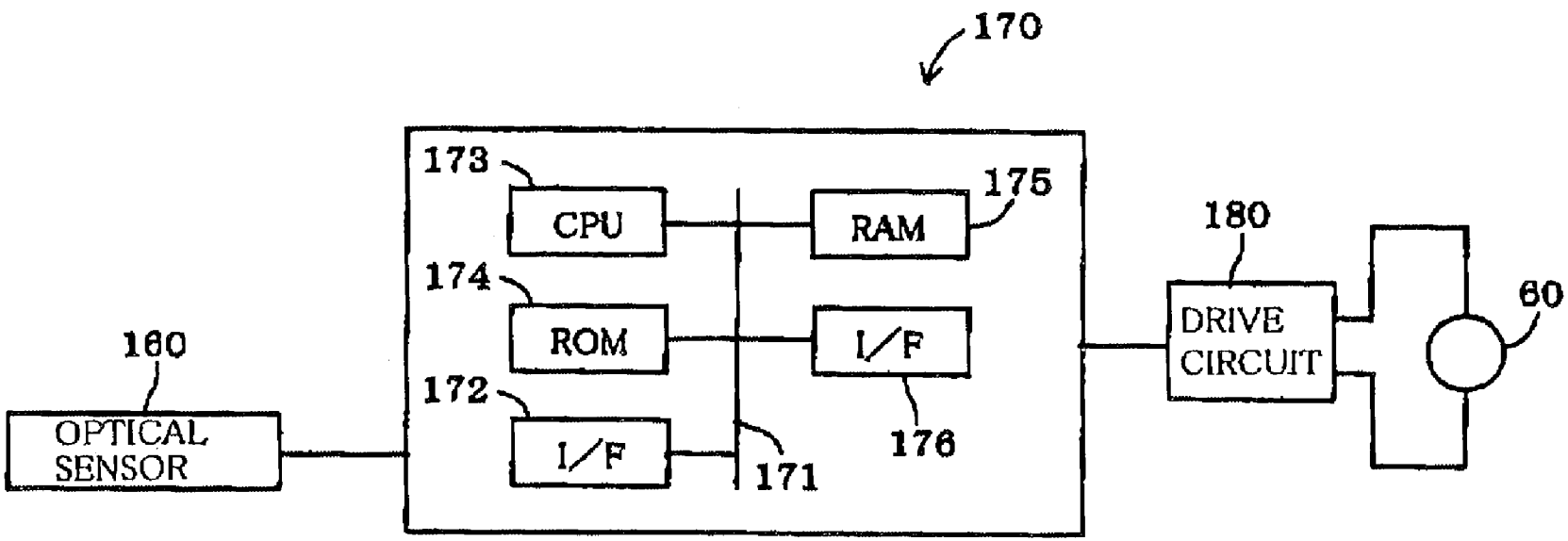
FIG. 8 is a block diagram of an electrical circuit of the ink filling apparatus.

There will be now described an electrical circuit of the ink filling apparatus, by referring to FIG. 8. An optical sensor 160 (turn detector) shown in FIG. 8 takes the form of a photointerrupter, which is disposed on a protruding portion that protrudes from an end portion of the second segment of the right side wall 32 of the support table 30, as shown in FIGS. 3 and 4. When the first arm 72 of the arm member 70 engages with the first stopper portion 32*a*, namely, when the first arm 72 is brought into abutting contact with the first stopper portion 32*a*, the optical sensor 160 detects this engagement of the first arm 72. This means that the optical sensor 160 detects that the idler gear 80*b* is engaged with the external gear portion 142*b* of the internally threaded member 142.

Figure 9:
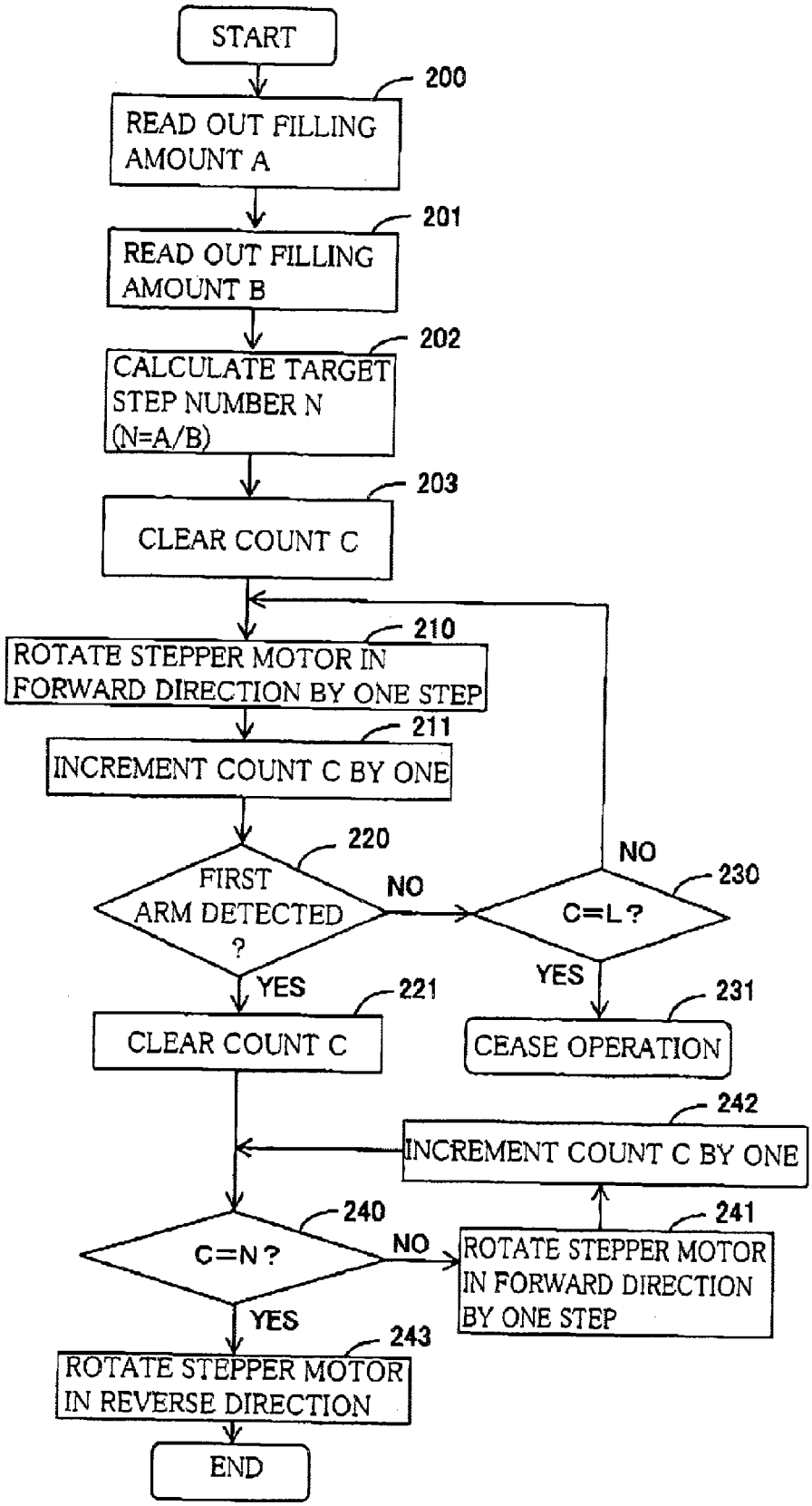
FIG. 9 is a flowchart illustrating an operation of a CPU shown in FIG. 8.

As shown in FIG. 8, a control circuit 170 is configured such that an interface (I/F) 172, a CPU 173, a ROM 174, a RAM 175, and an interface (I/F) 176 are connected one another through a bus line 171. The CPU 173 executes various kinds of processing, such as receiving an output from the optical sensor 160 and driving a drive circuit 180, according to a program as illustrated in FIG. 9. The program is stored in the ROM 174 so that the CPU 173 can read out the program. The RAM 175 stores various kinds of data.

The drive circuit 180 is for driving the stepper motor 60 in the single-phase exciting method, for instance. That is, the drive circuit 180 is controlled by the CPU 173 to apply drive pulses to the stepper motor 60 to rotate the stepper motor 60 stepwise in the forward or reverse direction, in a single phase.

There will be described how the ink cartridge K is attached to the ink filling apparatus.

Initially, the ink cartridge K or the cylinder 100 is inserted from the side of its first cylindrical part 110 into the insertion through-hole 31*a* in the board 31 of the support table 30. After the arcuate protrusions 114 of the first cylindrical part 110 reach the insertion through-hole 31*a*, the first cylindrical part 110 is further inserted with outer surfaces of the arcuate protrusions 114 fitting an inner circumferential surface of the insertion through-hole 31*a*.

Thereafter, when the linking protrusions 112 of the first cylindrical part 110 are brought into contact with the edge of the insertion through-hole 31*a*, the ink cartridge K or the cylinder 100 is rotated 90°. By this, the first cylindrical part 110 is fixed in position at the board 31 such that the linking protrusions 112 and the arcuate protrusions 114 of the cylindrical part 110, which are on the upper and under sides of the edge of the insertion through-hole 31*a*, respectively, hold the edge therebetween.

At the same time, the ink port 116 of the first cylindrical part 110 is inserted into the fitting hole 41 of the connecting portion 40 on the base 10, so as to be connected to the supply tube 50*b* of the ink tank T. In this way, the ink cartridge K is attached to the ink filling apparatus.

After the ink cartridge K has been attached to the ink filling apparatus, the control circuit 170 is placed. in an operating state so that the above-mentioned program is executed. That is, an operation of the control circuit 170 is implemented according to the flowchart shown in Fig. 9. There will be described in detail the operation of the control circuit 170, by referring to FIG. 9. The operational flow begins with step 200 in which the CPU 173 reads out a predetermined first filling amount A from the ROM 174. In the next step 201, the CPU 173 reads out a predetermined second filling amount B from the ROM 174. It is assumed that in this case the idler gear 80*b* is currently disengaged from the external gear portion 142*b* of the internally threaded member 140 of the ink cartridge K, and the first arm 72 of the arm member 70 is currently engaged with the second stopper portion 33*a*, as shown in FIG. 3.

The first filling amount A is a maximum amount of ink the ink cartridge K can accommodate. The second filling amount B is an amount of ink to be supplied into the ink cartridge K by rotating the stepper motor 60 by a single step (which corresponds to a unit rotational angle). The first and second filling amounts A, B are stored in the ROM 174 in advance.

Then, in step 202, a target step number N is calculated. The target step number N represents the number of steps by which the stepper motor 60 is to be rotated in order to supply an ink of the filling amount A into the ink cartridge K. More specifically, the target step number N is obtained from the following equation (1), based on the filling amounts A and B read out in steps 200 and 201:

$$N=A/B \tag{1}$$

After step 202, the operational flow goes to step 203 to clear or zero a count C, which represents the number of steps by which the stepper motor 60 has been actually rotated.

In the following step 210, a pulse signal for rotating the stepper motor 60 by a single step in the forward direction is outputted from the CPU 173 to the drive circuit 180. On receiving the pulse signal the drive circuit 180 operates to rotate the stepper motor 60 by a single step in the forward direction.

The pinion 80*a* accordingly rotates in the same direction as the stepper motor 60, by a rotational angle corresponding to the single step of the stepper motor 60. By this rotation of the pinion 80*a*, the idler gear 80*b* is turned around the pinion 80*a*, or, turned with the arm member. 72 around the output shaft 62 of the stepper motor 60.

That is, the arm member 70 is connected to the output shaft 62 of the stepper motor 60 such that the arm member 70 is swingable or turnable around the output shaft 62, as described above. Hence, with the frictional force applied to the idler gear 80*b* from the frictional member 90*b*, the idler gear 80*b* in engagement with the pinion 80*a* turns or rotates around the output shaft 62 of the stepper motor 60 in the clockwise direction as seen in FIG. 3. That is, the arm member 70 is coupled to the idler gear 80*b* by an arrangement to generate the frictional force between the arm member 70 and the idler gear 80*b*, which includes the support shaft 81, the frictional member 90*b*, and the conical spring washer 90*a*, in order to rotate the arm member 70 and the idler gear 80*b* together around the output shaft 62 of the stepper motor 60 while the arm member 70 is turned between the first and second stopper portions 32*a*, 33*a*. Therefore, the arm member 70 is swung or turned integrally with the idler gear 80*b* in a direction to bring the idler gear 80*b* into engagement with the external gear portion 142*b* of the internally threaded member 142, and the first arm 72 of the arm member 70 is disengaged from the stopper portion 33*a*.

After step 210, the operational flow goes to step 211 to increment the count C by one.

Then, in the following step 220, it is determined whether the optical sensor 160 has detected the first arm 72 of the arm member 70 brought into contact with the first stopper portion 32*a*. Since in this assumed case the first arm 72 was separated from the stopper portion 33*a* just now and is currently located apart from the stopper portion 32*a*, a negative decision NO is made in step 220.

In the next step 230, it is determined whether the count C is equal to a predetermined upper limit L of step number N. The upper limit L is set at a number slightly larger than the number of steps by which the stepper motor 60 should be rotated in order to turn the first arm 72 of the arm member 70 from one of the stopper portions 32*a*, 33*a* to the other of the stopper portions 32*a*, 33*a*.

In this assumed case, the count C is currently 1 and smaller than the upper limit L. Hence, a negative decision NO is made in step 230. Then, the processing of a loop of steps 210, 211, 220 and 230 is repeated. During the repeat of the processing, the stepper motor 60 rotates in the forward direction by a single step each time the stepper motor 60 receives, from the drive circuit 180, the drive pulse for driving the stepper motor 60 in the forward direction by one step. Such a rotation of the stepper motor 60 rotates the pinion 80*a* in the forward direction, and also turns the idler gear 80*b* around the output shaft 62 of the stepper motor 60 with the arm member 70 coupled to the idler gear 80*b*, as described above.

Then, the idler gear 80*b* engages with the external gear portion 142*b* of the internally threaded member 142, and the first arm 72 of the arm member 70 engages with the first stopper portion 32*a*, as shown in FIG. 4, with the latter engagement detected by the optical sensor 160.

An affirmative decision YES is now made in step 220 based on the output from the optical sensor 160 that indicates the engagement of the first arm 72 with the first stopper portion 32*a*. Hence, the operational flow goes to step 221 to clear or zero the count C. The operational flow then goes to step 240 to determine whether the count C is equal to the target step number N or not. In this assumed case, the count C is smaller than the target step number N, and the operational flow goes to step 241 to further rotate the stepper motor 60 in the forward direction by a single step. As described above, it is so adjusted that when the stepper motor 60 is rotated in the forward direction, after the arm member 70 is brought into contact with the first stopper portion 32*a*, the idler gear 80*b* rotates in sliding contact with the frictional surface 91 of the frictional member 90*b* while the arm member 70 is stationary, Hence, the stepper motor 60 rotates in the forward direction by a single step in response to the drive pulse from the drive circuit 180, while the arm member 70 is held engaged with the first stopper portion 32*a*.

Accordingly, the pinion 80*a* rotates in the same direction as the stepper motor 60, that is the forward direction, by the rotational angle corresponding to the single step of the stepper motor 60, which in turn rotates the idler gear 80*b* in the reverse direction. Hence, the internally threaded member 142 rotates in the forward direction, i.e., the same direction as the stepper motor 60, thereby moving the threaded shaft 141 toward an upper end of the second cylindrical part 120 which is the axial end remote from the first cylindrical part 110, by the operation of the feed screw mechanism 140.

After the rotation of the stepper motor 60 in the forward direction by the single step in step 241, the operational flow goes to step 242 to increment the count C by one. Thereafter, the processing of a loop of steps 240, 241 and 242 is repeated.

During the repeat of the processing, the stepper motor 60 is rotated by a single step each time the stepper motor 60 receives the drive pulse from the drive circuit 180. The rotation of the stepper motor 60 by the single step rotates the pinion 80*a* in the forward direction. This in turn rotates the idler gear 80*b* in the reverse direction, which rotates the internally threaded member 142 in the forward direction. By the operation of the feed screw mechanism 140 including the internally threaded member 142, the threaded shaft 141 is further fed toward the upper end of the second cylindrical part 120.

Accordingly, the ink is sucked from the mainbody 50*a* of the ink tank T into the ink chamber 117 via the supply tube 50*b* and the ink port 116, to fill the ink chamber 117.

After the repetition of the processing of steps 240-242 for some time, the count C having been kept updated or incremented in step 242 eventually reaches the target step number N as calculated in step 202, and an affirmative decision YES is made in step 240. This means that the ink has been supplied into the ink cartridge K in the filling amount A, which is the maximum ink amount the ink cartridge K can accommodate. It is noted that the drive unit D, the drive circuit 180, and a portion of the control unit 170 which implements steps 220, 221, 240, 241 and 242 cooperate to constitute an ink fill controller.

When an affirmative decision YES is made in step 240, the operational flow goes to step 243 to rotate the stepper motor 60 in the reverse direction. That is, in step 243, a drive pulse for rotating the stepper motor 60 in the reverse direction by a single step is repeatedly outputted from the CPU 173 to the drive circuit 180. Each time the drive circuit receives such a drive pulse, the drive circuit 180 operates to rotate the stepper motor 60 in the reverse direction by a single step.

Thus, the pinion 80*a* rotates in the same direction as the stepper motor 60, i.e., the reverse direction, and at the rotational angle corresponding to the single step of the stepper motor 60. The idler gear 80*b* accordingly turns in the reverse direction along with the arm member 70.

That is, the arm member 70 is connected to the output shaft 62 such that the arm member 70 is swingable or turnable therearound, as described above. Hence, with the frictional force applied to the idler gear 80*b* from the frictional member 90*b*, the idler gear 80*b* in engagement with the pinion 80*a* turns or rotates around the pinion 80*a* or the output shaft 62 of the stepper motor 60 in the counterclockwise direction as seen in FIGS. 3 and 4, with the arm member 70 being swung or turned integrally with the idler gear 80*b* in a direction to disengage the idler gear 80*b* from the external gear portion 142*b* of the internally threaded member 142. The first arm 72 of the arm member 70 is accordingly disengaged from the stopper portion 32*a*, and eventually engaged with the stopper portion 33*a*. This engagement of the first arm 72 with the stopper portion 33*a*inhibits further turning of the arm member 70 along with the idler gear 80*b* around the output shaft 62 of the stepper motor 60.

In a case where an affirmative decision YES is made in step 230 before the affirmative decision YES is made in step 220 during the loop of steps 210, 211, 220 and 230 is repeated, it is determined that a failure of some kind is occurring in the ink filling apparatus. Hence, the operational flow goes to step 231 to stop the operation of the present cycle, namely, the processing by the CPU 173 is ceased.

According to the present embodiment, the internally threaded member 142 of the feed screw mechanism 140 is exposed at its external gear portion 142*b* to the exterior, at a position between the open end 125 of the second cylindrical part 120 of the cylinder 100 and the annular assisting member 130. This enables to move the piston 150 in the cylinder 100 by means of the feed screw mechanism, simply such that the idler gear 80*b* of the drive unit D rotates the internally threaded member 142. Thus, the ink chamber 117 of the ink cartridge K can be easily filled with the ink, with a simple structure.

Since the internally threaded member 142 accurately and precisely transmits an operation of the stepper motor 60 to the threaded shaft 141 via the pinion 80*a* and the idler gear 80*b*, the amount of the ink supplied into the ink cartridge K is controllable with high accuracy and precision.

Since the threaded shaft 141 and the piston 150 are fitted in the cylinder 100 such that the threaded shaft 141 does not protrude out of the cylinder 100 when the internally threaded member 142 is rotated, safety of a user is ensured.

The drive unit D operates to fill the ink chamber 117 of the ink cartridge K with the ink as supplied from the ink tank T only when the optical sensor 160 detects engagement of the first arm 72 of the arm member 70 with the stopper portion 32*a*, that is, when the optical sensor 160 detects engagement of the idler gear 80*b* with the internally threaded member 142. Hence, filling of the ink chamber 117. With the ink is performed with enhanced accuracy.

Since the stepper motor 60 is employed as means for driving the drive unit D, it is enabled to accurately and precisely fill the ink chamber 117 with the ink, simply by counting the number of steps by which the stepper motor 60 is rotated.

The first embodiment may be variously modified. The following modification is possible, for instance. That is, unlike the first embodiment where the outer circumferential surface of the internally threaded member 142 is formed as the external gear portion 142*b*, the outer circumferential surface of the internally threaded member 142 according to a modified form is formed as a surface having a convexity and a concavity such as serration go that a user can manually rotate the internally threaded member 142.

When the ink cartridge K according to the first embodiment is used, that is, when the ink in the ink cartridge K is supplied to a printhead, the internally threaded member 142 is driven or rotated in a direction opposite to the direction in which the internally threaded member 142 was rotated to fill the ink chamber 117 with the ink, so that the threaded shaft 141 is axially moved in a direction toward the ink port 116, that is, a direction opposite to the direction in which the threaded shaft 141 was moved when the ink chamber 117 was filled with the ink. However, where the thread on the threaded shaft 141 has a sufficiently large lead angle and a sufficiently low frictional coefficient with respect to the internal engaging portion of the internally threaded member 142, the operation of the feed screw mechanism alters such that when the ink is sucked to the exterior of the ink chamber 117, a negative pressure produced by the outflow of the ink axially moves the threaded shaft 141 toward the ink port 116, and the internally threaded member 142 threadably engaged with the threaded shaft 141 is accordingly rotated around and relative to the threaded shaft 141. Such a sufficiently large lead angle and a sufficiently low frictional coefficient can be easily achieved when a ball screw mechanism is employed as the feed screw mechanism.

In the feed screw mechanism according to the first embodiment, to prevent the threaded shaft 141 from rotating with the internally threaded member 142 when the drive gear 90*b* is operated in meshing engagement with the external gear portion 142*b* of the internally threaded member 142, the assisting member 130 is disposed between the first cylindrical part 110 and the internally threaded member 142. However, in place of employing the assisting member 130, the feed screw mechanism may be modified to include an integral-rotation inhibiting device as described below and shown in FIG. 10 or 11.

Figure 10:
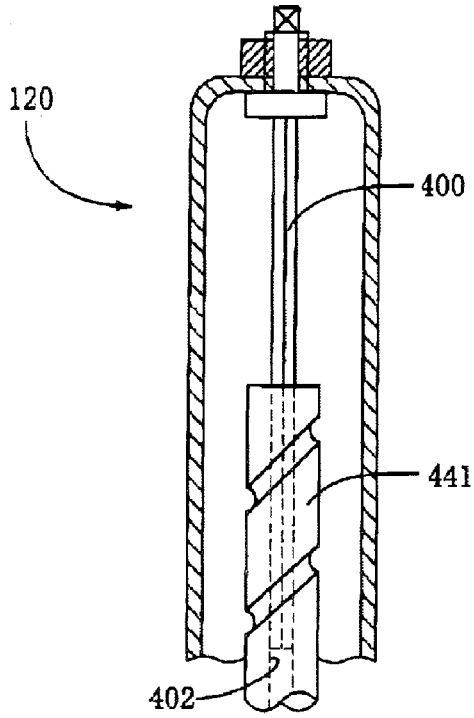
FIG. 10 shows a modified form of a feed screw mechanism of the first embodiment.

That is, FIG. 10 shows an arrangement where a bar member 400 is disposed to extend downward from an under surface of the upper end of the cylindrical part 120. A cross-sectional shape of the bar member 400 is not circular, and may be rectangular, for instance. Further, in place of the threaded shaft 141 used in the first embodiment, there is employed a threaded shaft 441 having an axially extending hole 402 configured such that the bar member 400 is fitted in the axially extending hole 402 such that threaded shaft 441 is axially movable but not rotatable relative to the bar member 400. Thus, when the internally threaded member 142 is rotated from the exterior, the threaded shaft 441 is axially moved along the bar member 400 and inhibited from rotating with the internally threaded member 142.

Figure 11:
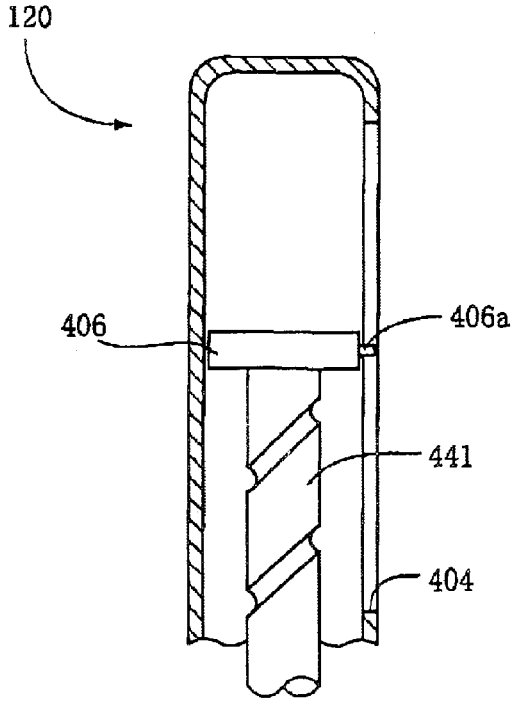
FIG. 11 is a cross-sectional view of another modified form of the feed screw mechanism.

FIG. 11 shows another arrangement where a slit 404 is formed through a thickness of a side wall of the cylindrical part 120 to extend in the axial direction of the cylindrical part 120. At an upper end of the threaded shaft 441, a head portion 406 is formed such that the head portion 406 is not rotatable relative to the threaded shaft 441, and is slidable on an inner circumferential surface of the cylindrical part 120. The head portion 406 has a protruding portion 406*a* that protrudes from the head portion 406 toward the exterior of the cylindrical part 120. The protruding portion 406*a* is engaged with the slit 404 such that when the internally threaded member 142 is rotated, the threaded shaft 441 does not rotate with the internally threaded member 142.

The above-described integral-rotation inhibiting devices are suitably employed particularly in the case where a ball screw mechanism is employed as the feed screw mechanism.

Figure 12:
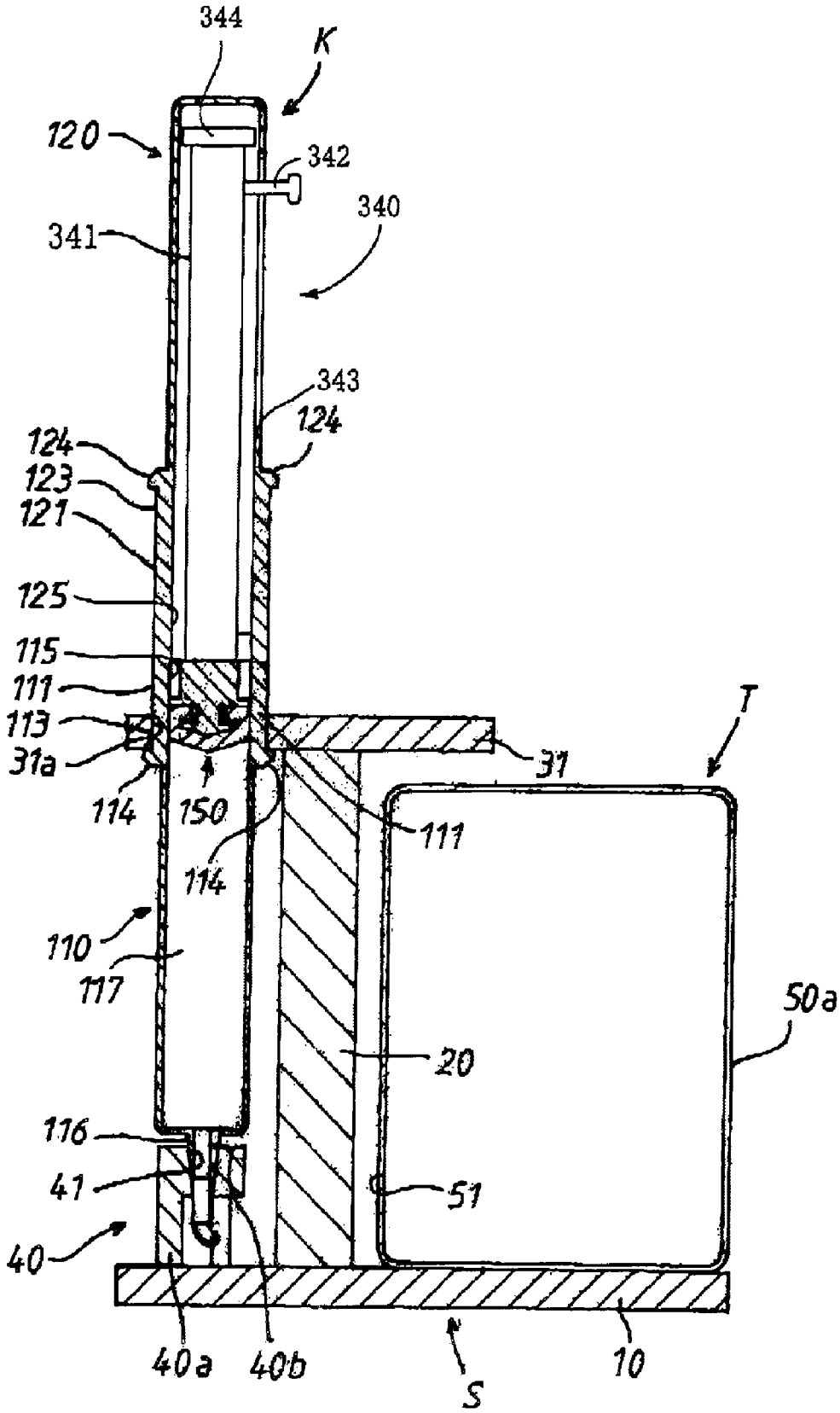
FIG. 12 is a cross-sectional view of an ink filling apparatus according to a second embodiment of the invention.

There will be now described an ink filling apparatus according to a second embodiment of the invention, by referring to FIG. 12.

In the first embodiment, the piston 150 fitted in the cylinder 100 is axially slid in the cylinder 100, using a driving or rotating force output from the stepper motor 60. In the second embodiment, in contrast, the piston 150 is axially slid by manual operation of a user, and the stepper motor 60 is not used. The other part of the ink filling apparatus of the second embodiment is identical with the first embodiment and description thereof is omitted. In the following detailed description of the second embodiment, the elements or parts corresponding to those of the first embodiment are designated by the same reference numerals.

As shown in FIG. 12, an ink cartridge K according to the second embodiment does not include the feed screw mechanism 140 constituted by the threaded shaft 141 and the internally threaded member 142, and the drive unit D constituted by the stepper motor 60, the arm member 70, the pinion 80*a*, and the idler gear 80*b*, that are used in the first embodiment. Instead, the ink cartridge K of the second embodiment includes a manually operable mechanism 340 that includes a piston rod 341, a guide 344, a finger grip 342, and a slit 343. Similar to the threaded shaft 141, the piston rod 341 axially movably extends inside cylinder 100 upward from a piston 150. The finger grip 342 radially extends from the piston rod 341 to the exterior of a cylindrical part 120, through the slit 343 that is formed through a side wall of the cylindrical part 120. When the user desires to slide the piston 150 to introduce an ink from an ink tank T, the user holds and axially slides the finger grip 342 along the slit 343.

According to the second embodiment, the piston 150 can be axially slid simply by operating the finger grip 342 from the exterior of the cylindrical part 120. Thus, an ink chamber 117 defined in the cylinder 100 can be easily filled with the ink, with a simple structure.

Although there have been described two embodiments of the invention, it is to be understood that the invention is not limited to the details of the embodiments, but may be otherwise embodied with various modifications and improvements that may occur to those skilled in the art, without departing from the scope and spirit of the invention defined in the appended claims. For instance, the following modification is possible.

That is, in each of the above-described embodiments, when the ink cartridge K is attached to or removed from the ink filling apparatus, the ink cartridge K is vertically moved, namely, inserted or taken out through the insertion through-hole 31*a*. However, the ink filling apparatus may be modified such that the ink cartridge K is attached to on or removed from the ink filling apparatus by laterally or horizontally moving the ink cartridge K.

It is not necessary to make the drive gear 90*b*, which serves as a switching gear, turnable or swingable with the arm member 70.

What is claimed is:

1. An ink cartridge comprising:

a cylindrical member having an ink port at one axial end thereof;

a piston which is fitted in the cylindrical member air-tightly and slidably, and partially defines an ink chamber within the cylindrical member, the ink chamber being in communication with the ink port;

a piston rod which is connected to the piston on the side opposite to the ink chamber, and extends in the cylindrical member along an axial direction of the cylindrical member; and a thrusting portion at least partially positioned in the cylindrical member and configured to apply a thrust force to the piston rod and thereby move the piston along the axial direction, the thrusting portion comprising a driven portion drivable from the exterior of the cylindrical member, wherein the cylindrical member includes a slit which communicates the interior of the cylindrical member with the exterior of the cylindrical member, and the driven portion extends from the piston rod in a radial direction of the piston rod and includes an operable portion which protrudes onto the exterior of the cylindrical member through the slit.

2. An ink cartridge comprising:

a cylindrical member having an ink port at one axial end thereof;

a piston which is fitted in the cylindrical member air-tightly and slidably, and partially defines an ink chamber within the cylindrical member, the ink chamber being in communication with the ink pot;

a piston rod which is connected to the piston on the side opposite to the ink chamber, and extends in the cylindrical member along an axial direction of the cylindrical member; and a thrusting portion at least partially positioned in the cylindrical member and configured to apply a thrust force to the piston rod and thereby move the piston along the axial direction, the thrusting portion comprising a driven portion drivable from the exterior of the cylindrical member, wherein the piston rod comprises a feed screw shaft, an outer circumferential surface of the feed screw shaft is externally threaded and the feed screw shaft is configured to be prevented from rotating relative to the cylindrical member, and wherein the thrusting portion comprises an internally threaded member, with which the feed screw shaft is threadably engaged, and which is configured to be rotatable relative to the cylindrical member in a plane perpendicular to the axial direction of the cylindrical member but immovable relative to the cylindrical member in the axial direction of the cylindrical member, an outer circumferential portion of the internally threaded member comprising the driven portion.

3. The ink cartridge according to claim 2, wherein the driven portion comprises an external gear, at least a part of which is accessible from the exterior.

4. The ink cartridge according to claim 2, wherein the cylindrical member includes a feed-screw-shaft accommodating portion which accommodates an entirety of the feed screw shaft when the piston is retracted to a most retracted position from the ink port.

5. The ink cartridge according to claim 2, wherein the cylindrical member includes a first cylindrical part and a second cylindrical part, each of which has at one of opposite ends thereof an open end which is open toward the exterior, the first and second cylindrical parts being connected to each other at the sides of the open ends thereof.

6. The ink cartridge according to claim 5, wherein the internally threaded member is disposed between the open ends of the first and second cylindrical parts, and at least one of the first and second cylindrical parts includes at least one linking portion which is disposed on the radially outer side of the internal threaded member to connect the first and second cylindrical parts to each other.

7. The ink cartridge according to claim 6, wherein the internally threaded member includes a first fitting portion formed at at least one of axially opposite ends of the internally threaded member, at least one of the first and second cylindrical parts includes a second fitting portion, and the first and second fitting portions are fitted to each other, while relative rotation between the internally threaded member and the cylindrical member is configured to be allowed.

8. The ink cartridge according to claim 6, further comprising an assisting member which is disposed between the open ends of the first and second cylindrical parts, along with the internally threaded member, and is fixed to at least one of the first and second cylindrical parts, wherein the feed screw shaft is engaged with the assisting member such that the feed screw shaft is not rotatable and axially movable relative to the assisting member.

9. An ink filling apparatus, comprising:

the ink cartridge according to claim 2;

a cartridge holder configured to detachably hold the ink cartridge;

an ink tank configured, to be connected to the ink port of the ink cartridge as held by the cartridge holder, and accommodates an ink; and a drive unit including a driving member, the drive unit configured to rotate the internally threaded member of the ink cartridge as held by the cartridge holder, by engagement of the driving member with the driven portion.

10. The apparatus according to claim 9, wherein the driving member comprises a drive gear, and the driven portion comprises an external gear.

11. The apparatus according to claim 9, wherein the drive unit further includes an electric motor as a drive source.

12. The apparatus according to claim 11, wherein the electric motor is a stepper motor.

13. The apparatus according to claim 11, wherein the electric motor is fixed in position relative to the cartridge holder, and wherein the drive unit further includes:

a motor gear fixed to a rotating shaft of the electric motor;

a turnable member which turns around an axis of the motor gear; and an idler gear which is rotatably held by the turnable member and kept in meshing engagement with the motor gear, the idler gear being configured to be moved by turning of the turnable member, between a meshing position to mesh with the external gear and a separating position to separate from the external gear.

14. The apparatus according to claim 13, further comprising:

a frictional-force generator configured to generate a frictional force between the turnable member and the idler gear in order to rotate the turnable member and the idler gear together around the rotating shaft of the electric motor; and a turn limiter configured to limit an angular range within which the turnable member can turn and which is defined between a first turn position and a second turn position, the idler gear separating from the external gear when the turnable member is at the first turn position, and meshing with the external gear when the turnable member is at the second turn position, and the idler gear being configured to rotate relative to the turnable member after the turnable member has turned to the second turn position from the first turn position and become incapable of further turning.

15. The apparatus according to claim 14, further comprising:

a turn detector configured to detect the turnable member having turned to the second turn position; and an ink fill controller configured to control an amount of rotation of the electric motor after the turnable member having turned to the second turn position is detected by the turn detector, in order to control an amount of the ink supplied into the ink cartridge.

16. The apparatus according to claim 9, wherein the cartridge holder includes:

a connecting portion which is in communication with the ink tank via a communication passage, and configured to be air-tightly connected to the ink port; and a holding portion configured to hold a portion of the cylindrical member which is axially remote from the ink port.

17. The apparatus according to claim 16, wherein the holding portion includes an insertion through-hole configured such that the cylindrical member is axially inserted from the side of the ink port therethrough, and the connecting portion includes a receiving portion configured to air-tightly fit the ink port when the cylindrical member is axially inserted through the insertion through-hole.

18. The apparatus according to claim 17, wherein the insertion through-hole has a shape not circular and the cylindrical member includes an engaging protrusion configured such that the engaging protrusion can pass through the insertion through-hole while the cylindrical member is held at a first angular position relative to an edge of the insertion through-hole, but the engaging protrusion is engaged with the edge when the cylindrical member is rotated relative to the edge to a second angular position after the engaging protrusion has passed through the insertion through-hole.

19. An ink cartridge comprising:

a cylindrical member having an ink port at one axial end thereof;

a piston which is fitted in the cylindrical member air-tightly and slidably, and partially defines an ink chamber within the cylindrical member, the ink chamber being in communication with the ink port;

a feed screw shaft which is connected to the piston on the side opposite to the ink chamber, and extends along an axial direction of the cylindrical member; and an internally threaded member threadably engaged with the feed screw shaft, and configured to be rotatable relative to the cylindrical member in a plane perpendicular to the axial direction of the cylindrical member but immovable relative to the cylindrical member in the axial direction of the cylindrical member, at least a part of the internally threaded member being operable from the exterior of the cylindrical member.

* * * * *